United States Patent [19]

Ignatiev et al.

[11] 3,939,684

[45] Feb. 24, 1976

[54] TWO-ROLL MACHINE FOR ROLLING-OUT DISC-TYPE ARTICLES

[76] Inventors: Alexei Kirillovich Ignatiev, Volgogradsky prospekt, 71, kv. 167; Nikolai Ivanovich Volodin, Pyatnitskaya ulitsa, 2, kv. 39; Mikhail Yankelevich Alshits, 16 Parkovaya ulitsa, 39, kv. 33; Evgeny Rozhdenevich Maskulia, M.Kalitnikovskaya ulitsa, 5, kv. 102; Alexandr Khaimovich Graifer, Lesnaya ulitsa, 8/12, kv. 29; Lia Menakhimovna Kurs, ulitsa Vorovskogo, 28, kv. 10; Jury Ivanovich Zelenov, Bolshevistsky pereulok, 11, kv. 6; Erlina Mavrikievna Rakhmanova, Zatsepsky val, 10/22, kv. 4; Nikolai Alexandrovich Cherchintsev, deceased, late of Moscow; by Nonna Alexeevna Krasilnikova, administrator, M.Kalitnikovskaya ulitsa, 5, kv. 72; by Alexandr Nikolaevich Cherchintsev, administrator, Molodogvardeiskaya ulitsa, 28, korpus 1, kv. 67, all of Moscow, U.S.S.R.

[22] Filed: July 31, 1974

[21] Appl. No.: 493,734

[52] U.S. Cl. ..... 72/86

[51] Int. Cl.[2] ..... B21H 5/00

[58] Field of Search ..... 72/86, 111, 84, 109

[56] References Cited

UNITED STATES PATENTS

| | | | |
|---|---|---|---|
| 305,706 | 9/1884 | Nioggemeier | 72/86 |
| 2,338,161 | 1/1944 | Ashton | 72/86 |
| 2,932,223 | 4/1960 | Chartrand et al. | 72/86 |
| 2,993,393 | 7/1961 | Kendall | 72/86 |

*Primary Examiner*—Milton S. Mehr

[57] ABSTRACT

A machine, comprising a portal-type bed, two slide rests located on circular guides rotatably mounted about shafts fastened to the bed, rolling heads mounted each in a corresponding slide rest so that they are capable of shifting with respect to the slide rest, rolling rolls set up in each head, a slide rest turning gear and a gear for displacing the rolling heads relative to the slide rests, a carriage with a gear for clamping an article being rolled, with said carriage being mounted movably on the bed to introduce the article into the rolling zone and to withdraw it therefrom, a carriage transfer gear linked mechanically to the slide rest turning gear, and drives of the above-mentioned gears.

1 Claim, 7 Drawing Figures

TWO-ROLL MACHINE FOR ROLLING-OUT DISC-TYPE ARTICLES

The present invention relates to metalworking by pressure, and more particularly to machines for rolling-out disc-type articles.

BACKGROUND OF THE INVENTION

Two-roll machines for rolling-out disc-type articles are known in the art comprising a portal bed; two rolling heads each incorporating a roll with a rotating gear; a gear for feeding the heads together with the rolls to the article so to roll it out, and for withdrawing them from the article into their original position; a carriage with gears adapted for clamping the article and carrying it into a rolling zone, and back to its original position; and drives for the above-mentioned gears.

In the known machines the driven rolls have only one degree of freedom, and are capable of travelling either along an arc of a circumference made by a large radius or along a straight line, with an angle being formed by the roll axes which is capable of increasing only.

The known machines are therefore suitable only for rolling out discs of a simple profile with their end face generatrices approaching a straight line.

In order to produce discs of a more intricate profile with projections on their end faces and bulgings on their rims, the discs rolled out on the known machines should undergo subsequent machining which results in a substantial increase in the cost of the finished articles owing to a higher metal consumption, and additional labour-consuming machining.

SUMMARY OF THE INVENTION

The main object of the invention is to provide a machine for rolling out disc-type articles which would enable the production of discs with end face generatrices thereof having an intricate configuration.

Said and other objects are achieved in a herein-proposed two-roll machine for rolling out disc-type articles, comprising a portal bed, two rolling heads incorporating each a roll with its rotating gear, a gear for feeding the heads together with the rolls to the article to roll it out and for withdrawing them from the article into their original position, a carriage with gears for clamping and carrying the article into a rolling zone and for returning it into its original position, and drives for the above-mentioned gears.

According to the invention, the machine is provided with two slide rests located on circular guides attached to the bed, said slide rests being capable of turning about vertical shafts fixed in the bed during the rolling operation, with each slide rest carrying one of said rolling heads movably mounted with respect to said slide rest, and with a gear for simultaneous revolution of both slide rests with the same speed, said gear being linked mechanically to the article carrying gear.

The essence of the present invention is thus the provision of a two-roll machine for rolling-out disc-type articles, with said machine enabling discs of different profile, particularly those with projections in the central portion of their blades, and on their rims, to be produced by rolling-out same, which allows for minimizing the scope of machining the rolled out articles and, hence, diminishing the metal requirements considerably.

BRIEF DESCRIPTION OF THE DRAWINGS

The present invention will be better understood from a consideration of a detailed description of an exemplary embodiment thereof, to be had in conjunction with the accompanying drawings, wherein.

DESCRIPTION OF THE PREFERRED EMBODIMENT

Figure 1:
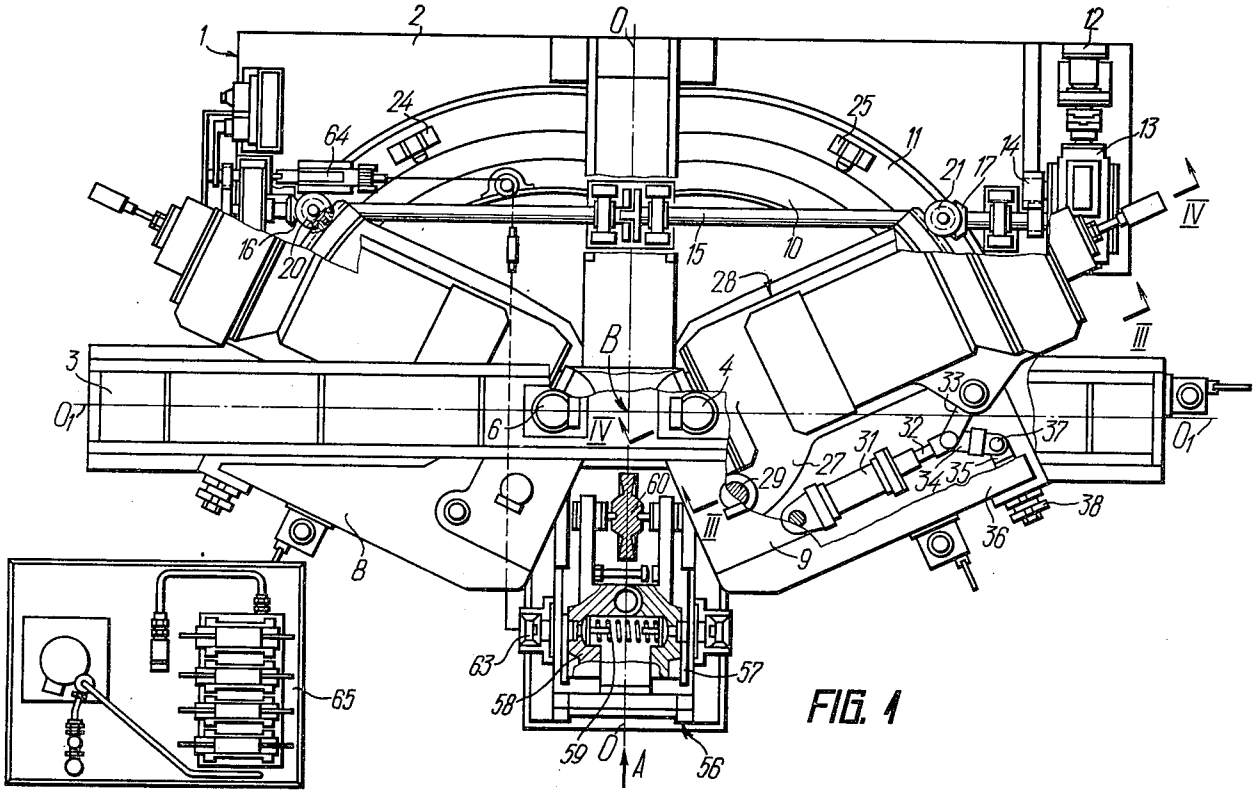
FIG. 1 shows a plan view of a two-roll machine for rolling out disc-type articles, according to the invention.
Figure 2:
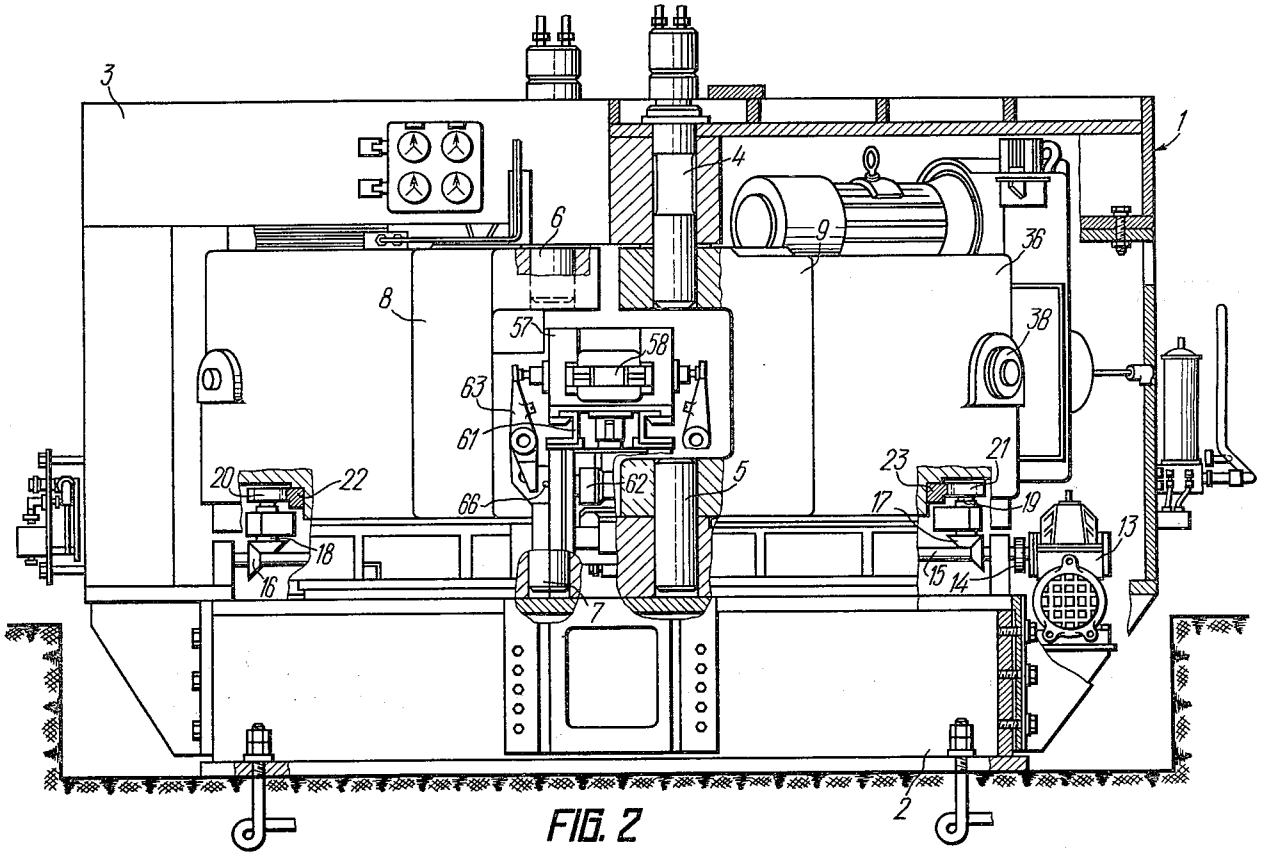
FIG. 2 — the same as FIG. 1, with a view along arrow A.

A bed 1 (FIGS. 1, 2 and 3) of the proposed machine comprises a flat box-type base plate 2 mounting a portal 3 (FIGS. 1,2). Fixed rigidly in the portal 3 and base plate 2, symmetrically with respect to the horizontal axis 0—0 of the machine, are columns 4, and 5, and 6, and 7 through which slide rests 8, and 9 (FIGS. 1,2) are articulated with said base plate 2 and portal 3.

The slide rests 8 and 9 are also of the box-type, and are capable of rotating about the columns 4, and 5, and 6, and 7 by shifting in a horizontal plane. During this movement the slide rests 8 and 9 rest on circular guides 10 (FIGS. 1 and 3) rigidly fixed on the upper plane of the base plate 2. L-shaped guides 11 are also made as a ring in a plan view, and are intended to provide proper positioning of the slide rests 8 and 9 during their travel along the plane of the base plate 2. In order to perform this revolution, the machine is provided with a hydraulic engine 12 (FIG. 1) which imparts the motion to a horizontal shaft 15 through a reducing gear 13 (FIGS. 1,2), and a pair of spur gears 14. The horizontal shaft 15 is connected, via pairs of bevel gears 16 and 17, to appropriate vertical shafts 18 and 19 (FIG. 2) carrying gears 20 and 21 (FIGS. 1,2) engaging geared rings 22 and 23 (FIGS. 2,3) rigidly fixed on the slide rests 8 and 9. Thus, both slide rests 8 and 9 turn simultaneously with the same speed about the axes of the columns 4, and 5, and 6, and 7, arranged symmetrically with respect to the horizontal axis 0—0 of the machine, with the slide rests 8 and 9 moving during the working stroke (during the rolling operation) to the axis 0—0 and drawing together. The working stroke of the rotating slide rests 8 and 9 (the end of the rolling operation) is completed, and hence, the switching off of the hydraulic engine 12 is effected as the slide rests 8 and 9 affect limit switches 24 and 25 (FIG. 1).

As shown in the drawing of FIG. 1, the machine is symmetrical with respect to the axis 0—0, and therefore given hereinbelow is a description of its right-hand half, with the left half being identical as a mirror image.

Figure 3:
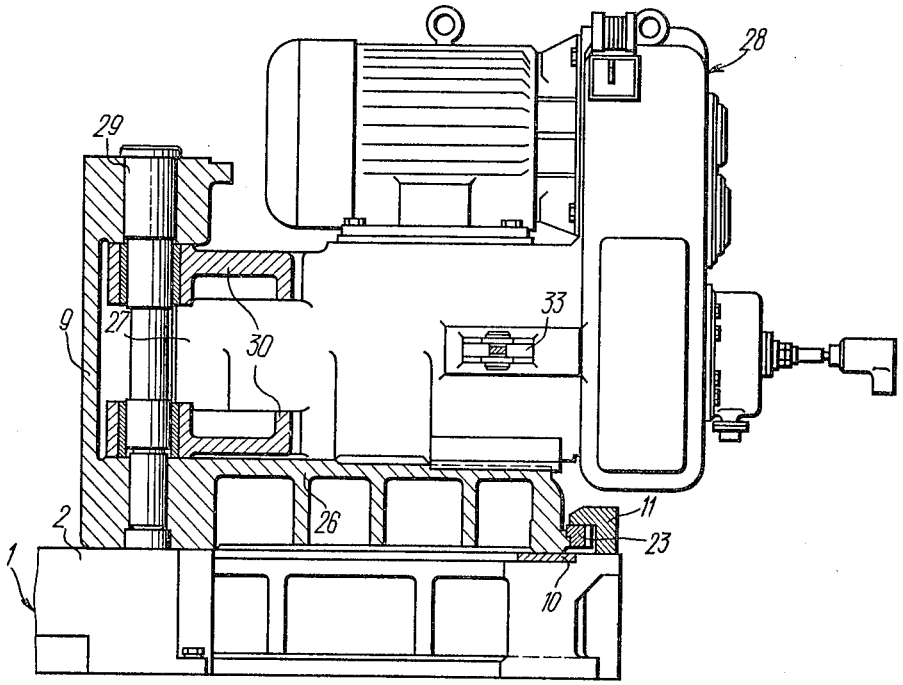
FIG. 3 — section III—III of FIG. 1.
Figure 4:
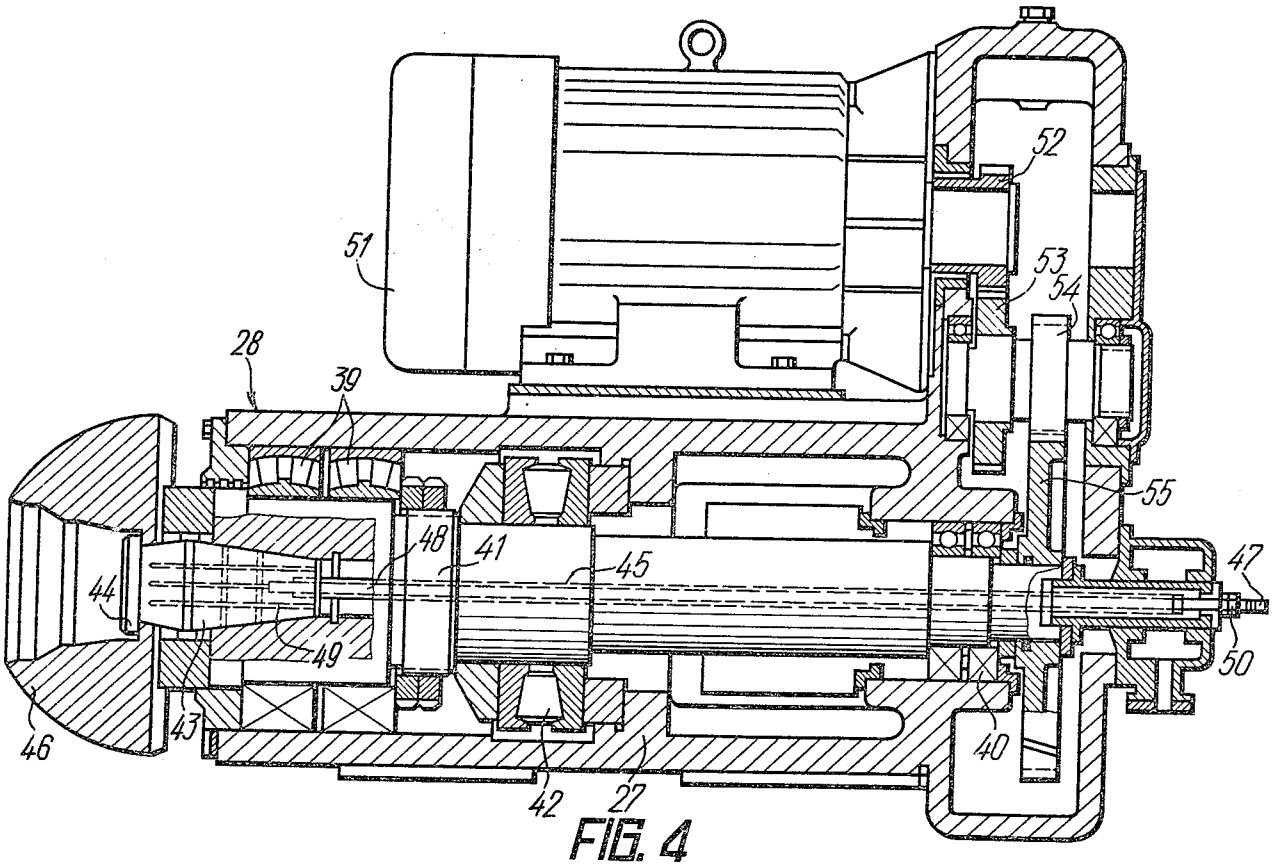
FIG. 4 — section IV—IV of FIG. 1.

A casing 27 (FIGS. 1,3,4) for a rolling head 28 is located on a bearing plane 26 (FIG. 3). The casing 27 is articulated with the slide rest 9 with the aid of a pivot 29 passing through lugs 30 (FIG. 3) of the casing 27 and slide rest 9.

The casing 27 is capable of rotating about the pivot 29, with its bearing planes sliding along the bearing plane 26 of the slide rest 9. Due to the above movement the rolling tool is withdrawn from the rolling zone "B" enabling an article to be fed, whereupon the tool is brought into contact with the article. As is seen from FIG. 1, the rolling zone "B" is located either on the machine axis 0—0, or in the vicinity of the axis.

In order to displace the casing 27 along the slide rest 9, the machine is furnished with a hydraulic ram 31 (FIG. 1) whose connecting rod 32 is articulated with arms 33 and 34. The arm 33 is in turn connected by means of a hinge joint to the head casing 27, with the arm 34 being articulated with a support 35 fastened to a vertical wall 36 of the slide rest 9 so that the position of a pivot 37 of the arm 34 can be adjusted with the aid of nuts 38 (FIGS. 1,2). Due to that adjustment, the casing 27 of the rolling head 28 can be set to requisite extreme positions as it shifts along the slide rest 9 to establish a proper contact between the tool and the article during the rolling operation.

In a working position when the article is being rolled out the casing 27 is not able to shift relative to the slide rest 9, since it is fixed by the force of the hydraulic ram 31, and by wedged (self-braking) arms 33 and 34.

The design of the rolling head is shown in FIG. 1.

A spindle 41 is mounted in radial bearings 39 and 40 in the casing 27 of the rolling head 28. Axial forces originating during the rolling process are taken up by a roller thrust bearing 42. A rolling roll 46 is fixed on the spindle 41 with the help of a cone 43, washer 44, and a rammer 45. During rolling, water for cooling the rolling roll 46, and elements in contact therewith, is fed through a sleeve 47, and a passage 48 of the rammer 45 branching out to form passages 49 in the cone 43.

The cone 43 is pulled with the help of the rammer 45, and nuts 50.

Rotation is transmitted to the spindle 41, and hence, to the rolling roll 46 fastened thereto from an electric motor 51 through two pairs of gears 52–53, and 54–55. The electric motor 51 is rigidly fixed on the casing 27 of the rolling head 28, and moves together with the casing 27.

In order to hold an article in place during rolling, to feed it into the rolling zone "B", and to bring it out of the zone, a rest 56 (FIG. 1) mounted in the front part of the machine on the axis 0—0 is utilized. The design of the rest 56 is shown in FIGS. 1 and 2. Tongs are mounted on a movable carriage 57, which are adapted for clamping an article 60 under the constant influence of a spring 59 (FIG. 1). The carriage 57 together with the tongs 58 and an article 60 is capable of travelling on guides 61 (FIG. 2) along the axis 0—0.

The movement is effected with the aid of a hydraulic ram (not shown in the drawing).

When the article 60 is fed into the tongs 58, and removed therefrom, the carriage 57 is set to a position most remote from the working zone "B" (article loading and unloading position). There a hydraulic ram 62 (FIG. 2) is fixed stationary which interacts with arms 63 compressing the spring 59, thus opening the tongs 58. Thus, the rolled out article can be removed, and a new one loaded.

During the rolling operation in order to correlate the speed of movement of the carriage 57 and the article 60 with the speed of rotation of the slide rests 8 and 9, the machine is provided with a hydraulic synchronizing gear 64 (FIG. 1). It may be a gear of a conventional type known to those skilled in the art, and it is not described hereinbelow as it is not the subject of the invention.

All the movements of the machine gears, other than the rotation of the rolling head spindles, are effected with the aid of hydraulic apparatus (the aforesaid hydraulic rams and hydraulic engine), with the latter being serviced by a hydraulic plant 65.

The two-roll machine for rolling-out disc-type articles is shown in FIGS. 1,2 and 3 with all its gears in their original positions, i.e.: with the carriage 57 being carried off from the rolling zone "B" at a maximum distance; with the connecting rod 66 of the hydraulic ram 62 being pushed forward due to the arms 63 having released the tongs 58; with the slide rests 8, and 9 being spaced apart at a maximum distance from the machine axis 0—0; and with the rolling heads 28 being shifted each along its slide rest 8, or 9 so that the rolling rolls are withdrawn from the machine axis 0—0. With the rolling heads 28 set to the above position, the connecting rod 32 of the hydraulic ram 31 is pulled in, and the arms 33 and 34 "folded".

Figure 5:
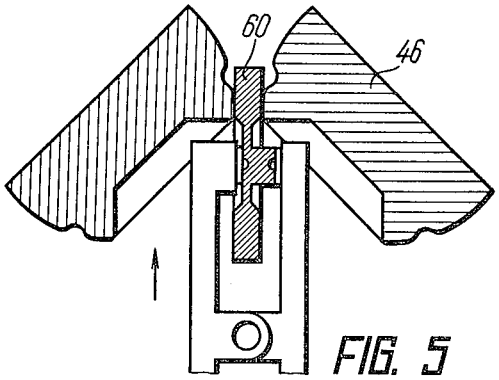
FIG. 5 shows the relative position of the rolling rolls, and the blank as the article is being fed into the rolling zone.

The relative position of the rolling roll 46 and article 60 at this moment is shown in FIG. 5.

Having placed the article 60 to be rolled out in the tongs 58, an operator depresses the button "START" whereupon the arms 63 depart from the tongs 58, and the article 60 is clamped under the influence of the spring 59.

Further operations of the herein-proposed machine is performed by using the following sequence of operations:

the carriage 57 with the tongs 58, and article 60 is introduced into the rolling zone "B"; both heads 28 with the rotating rolling roll 46 are simultaneously carried to the article 60.

To this end the hydraulic ram 31 turns the casing 27 of the head 28 with the help of the arms 33, and 34 until the rolling roll 46 commences to deform the article 60, with the head 28 being fixed in this position with respect to the slide rest 8, or 9 with the aid of the ram 31, and wedged arms 33, and 34.

The synchronous displacement of the two heads, with each of them being set in motion by a corresponding ram, is effected by a hydraulic synchronozing gear (not shown in the drawing), which is not described here as such may be of conventional design as in the preceeding synchronizing gear 64.

Figure 6:
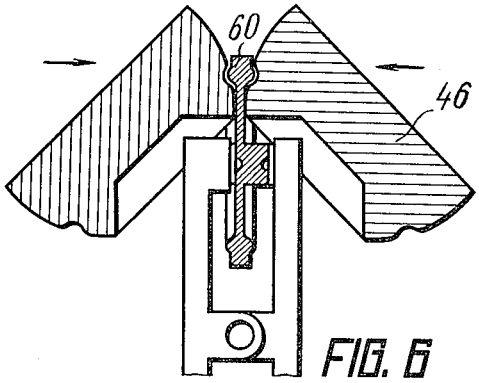
FIG. 6 — the same as in FIG. 5, except at the beginning of the rolling operation.

The relative arrangement of the rolling roll 46 and article 60 at the end of the motion of the rolling head 28 to the article 60 corresponds to the beginning of the rolling operation and is shown in FIG. 6.

Both slide rests 8 and 9 turn about the appropriate columns 4, and 5, and 6, and 7 in the direction of the machine axis 0—0, thus rolling-out the article 60. At the same time the clamp carriage 57 together with the article 60 same withdraws to return it to its original position, the withdrawal of the article being dependent on with the angle of revolution of the slide rests effected by the hydraulic synchronizing gear 64.

The gear 64 ensures an agreement of the withdrawal of the article from the rolling zone "B", and an increment in the diameter of the article which depends upon the angle of deflection of the slide rest at a given moment. Owing to this an article can be rolled out without slippage.

Figure 7:
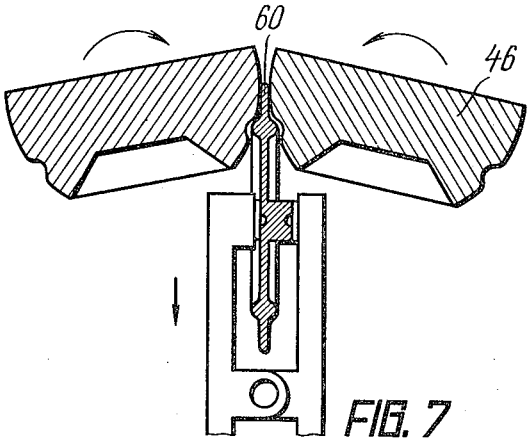
FIG. 7 — the same as in FIG. 5, except at the end of the rolling operation.

The relative arrangement of the rolling roll 46, and the article 60 at the end of the rolling operation is shown in FIG. 7.

After the working revolution of the slide rests 8, and 9, and the rolling process have been completed, the heads 28 with the tool 46 depart from the article by turning about the pivots 29, i.e. by shifting along the slide rests 8 and 9. The tongs 58 with the article 60, which does not interact anymore with the rolling roll 46, move rapidly to their original position.

At the same time the slide rests 8 and 9 also return to their original position rotating about the columns 4, and 5, or 6 and 7 in the direction of the machine axis 0—0.

The hydraulic ram 62 acting on the arms 63 which compress the spring 59 of the tongs 58, releases the article 60. The latter falls into a trough, and slides along it across the entire machine bed into a special receiving tare. After that the machine is ready for charging the following next article to be rolled-out.

We claim:

1. A two-roll machine for rolling-out disc-type articles, comprising: a portal-type bed; circular guides fastened to said bed; two slide rests arranged on said circular guides rotatable about vertical shafts attached to said bed; rolling heads mounted each in one of said slide rests movable with respect to the corresponding slide rest; rolling rolls with a rotating gear with each roll being set up in one of said heads; a gear for turning the slide rests along the circular guides, said gear being installed on said bed; a gear for carrying said heads relative to said slide rests; a carriage with an article clamping gear, said carriage being movably mounted on said bed to introduce the article into the rolling zone and to withdraw it herefrom; a carriage transfer gear set up on the bed, and linked mechanically to said rest turning gear; drives for the above-mentioned gears.

* * * * *